US005628642A

United States Patent [19]

Bieringer et al.

[11] Patent Number: 5,628,642

[45] Date of Patent: May 13, 1997

[54] ELECTRICAL CONNECTOR

[75] Inventors: Anton Bieringer, Schwabach; Peter Nützel, Nürnberg, both of Germany

[73] Assignee: Framatome Connectors International, Courbevoie, France

[21] Appl. No.: 433,462

[22] PCT Filed: Dec. 8, 1993

[86] PCT No.: PCT/EP93/03448

§ 371 Date: May 11, 1995

§ 102(e) Date: May 11, 1995

[87] PCT Pub. No.: WO94/14212

PCT Pub. Date: Jun. 23, 1994

[30] Foreign Application Priority Data

Dec. 8, 1992 [DE] Germany ..... 42 41 256.0

[51] Int. Cl.[6] ..... H01R 13/62

[52] U.S. Cl. ..... 439/157; 439/153

[58] Field of Search ..... 439/152–160, 439/372

[56] References Cited

U.S. PATENT DOCUMENTS 5,172,998 12/1992 Hatagishi .

5,296,696 3/1994 Okada et al. ..... 439/166

FOREIGN PATENT DOCUMENTS

| | | |
|---|---|---|
| 459448 | 5/1991 | European Pat. Off. . |
| 1590311 | 8/1956 | Germany . |
| 1151580 | 7/1963 | Germany . |
| 3826332 | 9/1991 | Germany . |
| 4129236 | 10/1992 | Germany . |
| P4241256.0 | 12/1993 | Germany . |
| 4-218279 | 8/1992 | Japan . |
| 2179506 | 3/1967 | United Kingdom . |

*Primary Examiner*—David L. Pirlot

*Attorney, Agent, or Firm*—Pollock, Vande Sande & Priddy

[57] ABSTRACT

An electrical connector with a first housing part receiving socket contacts, and a second housing part receiving knife contacts, where the two parts of the housing can be locked together and released by means of pins or the like, firmly attached to the housing parts. A single U-shaped clamp is mounted on one part of the housing and has legs with linking grooves in the region of board-shaped expansions. The grooves can be swung onto pins of the other housing part. The legs are provided with springy chamfers which, in the release position, are braced as stop elements again that housing part which carries the clamp. A locking hook mounted resiliently on a housing part reaches releaseably into a recess or hole in the cross piece of the clamp when the latter is in the locking position.

10 Claims, 2 Drawing Sheets

ELECTRICAL CONNECTOR

FIELD OF THE INVENTION

The invention relates to an electrical connector with a first housing part, receiving socket contacts, and with a second housing part, receiving knife contacts, which the two parts of the housing can be locked together and released by means of pins or the like, firmly attached to the parts of the housing, and pivotable clamps.

BACKGROUND OF THE INVENTION

In a known connectors of this kind, one part of the housing has two U-shaped clamps, which can be swung with recesses provided in the legs onto pins of the other part of the housing and can be locked by means of expansions, formed in the rim surfaces of the recesses as detents, at these expansions. Apart from the fact the clamps can be operated only separately in succession, whereby it is possible to tilt the parts of the housing with respect to each other, the expansions acting as detents require a significant amount of energy to swing on or release the clamps, having a negative mechanical effect on pins and clamps. In addition, the detents provided at the clamps do not function reliably. In addition, this known connector is difficult to manipulate due to the independently uncontrollable swivelling of the clamps before or during the plugging operation of the parts of the housing.

SUMMARY OF THE INVENTION

The object of the invention is to provide a connector of the aforementioned type which is designed to simplify the manipulation and to reliably stop the parts of the housing. According to the invention, this object is achieved by arranging of a single U-shaped clamp, which is pivot-mounted on one part of the housing and which has legs with linking grooves in the region of the board-shaped expansions and, which can be swung onto pins of the other part of the housing. The legs are provided with springy chamfers, which in the opening position are braced as stop elements against the part of the housing which carries the clamp, and a cutout, notch, hole or the like, into which a locking hook mounted resiliently on a part of the housing reaches releasably when the clamp is in the locking position, is provided in the cross piece of the clamp. In the case of housing parts whose cross section is substantially rectangular, the articulated points for the clamp are preferably provided in the narrow sides of the first part of the housing. In this manner the clamp can be stopped in the open position and locked in the coupling position, thus enabling both parts of the housing to be pre-plugged without hindrance and by subsequent pivoting of the clamp, with or without additional tightening effect during the plugging operation, achieving a reliable contact between socket and knife contacts as well as locking of the clamp, and, in the coupling position, a reliable stay of the parts of the housing at each other. Since the locking means are separated from the linking groove or that part of the legs that acts with the pins, the pins and the clamp remain in an advantageous manner virtually free of disturbing mechanical stresses.

The springy segments of the clamp allow the formation of a pre-plug position, where simply strip-shaped chamfers are used in the region of the clamp legs, whose one segment is bent in or bent down in the direction of the first part of the housing and which enable by reaching behind the first part of the housing with the bent in or bent down parts a resilient fixation. In addition, it has proven to be advantageous if the linking grooves exhibit bends, extending at right angles to the swivel planes of the legs, on at least the boundary surfaces reaching behind the pins. The bends allow the compression of surfaces to be kept to a minimum, thus preventing the boundary surfaces of the linking grooves to cut into the circumferential surfaces of the pins, even in the case of repeated locking operatings.

Finally it is also provided that the locking hook for the clamp is arranged preferably on a strip-shaped extension of the first part of the housing and the extension is designed counter to the effect of a restoring force to release the locking hook and can be bent down out of the cutout, recess, hole or the like of the clamp. To release the clamp with a small amount of energy, it is also provided that the thickness of a segment of the extension is reduced in comparison to the walls of the part of the housing. It is obvious that when the clamp is swung into the locking position, the locking hook is first automatically swung inwardly with a sloped butting face counter to the restoring force of the extension and subsequently under the influence of the restoring force also enters automatically into the cutout, recess or hole of the clamp. By depressing the locking hook and bending down the extension, the clamp is freed of the locking forces and can be swung back with a small amount of energy into the releasing position of the parts of the housing.

BRIEF DESCRIPTION OF THE DRAWINGS

The invention will now be explained with reference to the drawings.

DETAILED DESCRIPTION

Figure 1:
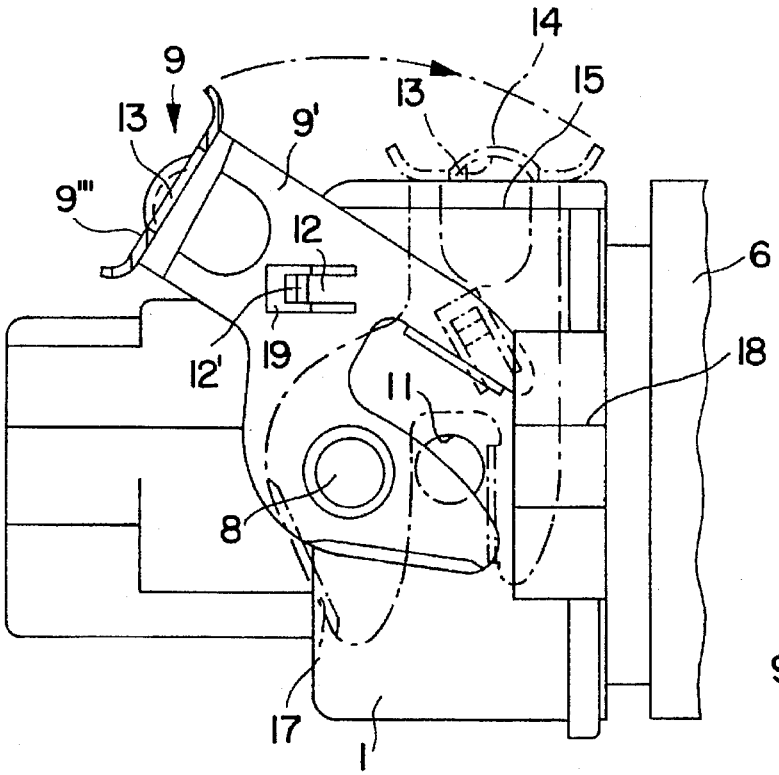
FIG. 1 is a side view of a connector with two housing parts.
Figure 2:
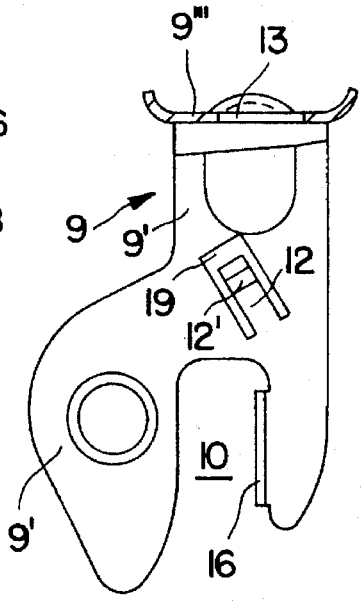
FIG. 2 is a side view and in part a sectional view of a clamp.
Figure 3:
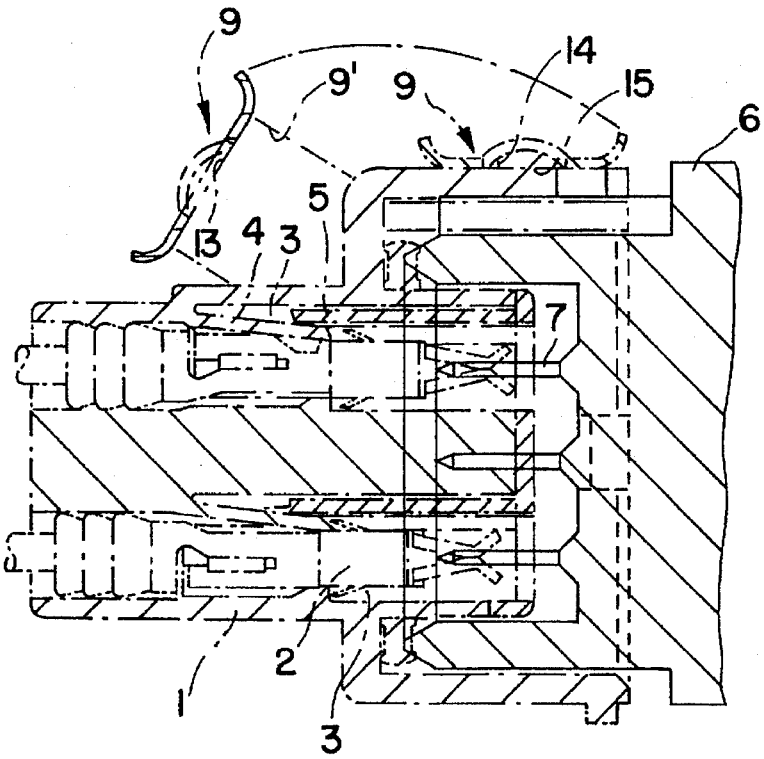
FIG. 3 is a sectional view of a connector.
Figure 4:
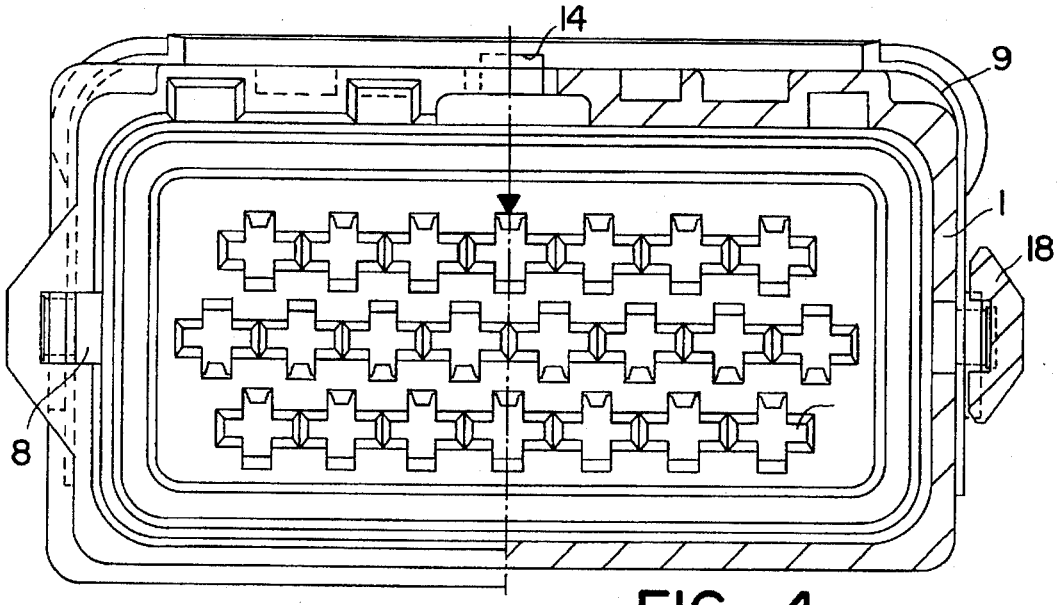
FIG. 4 is a front view, in part a sectional view, of a first part of the housing of a connector.
Figure 5:
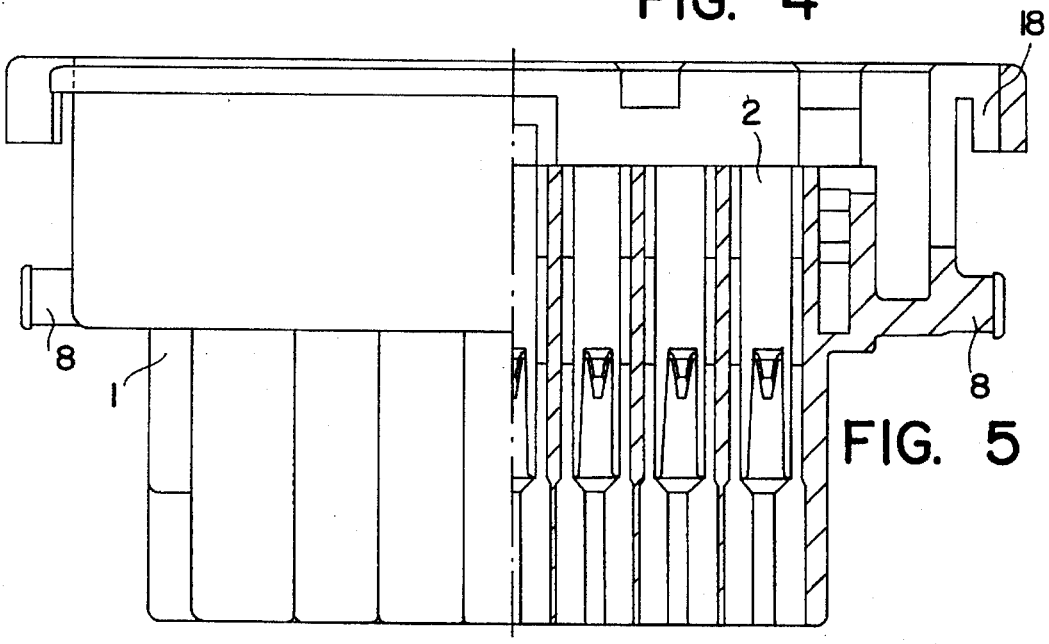
FIG. 5 is a top view, in part a sectional view, of a first part of the housing.
Figure 6:
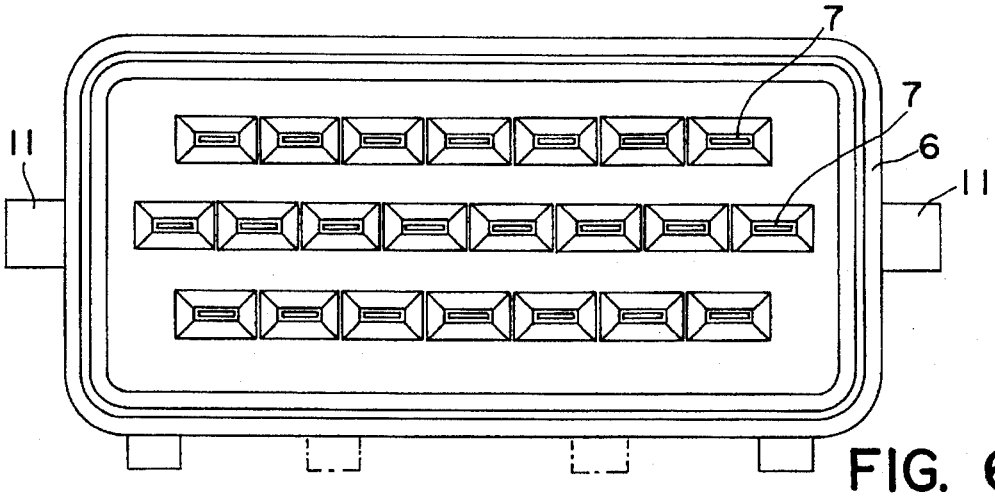
FIG. 6 is a front view of a second part of the housing.

FIG. 1 shows a first part 1 of the housing, which receives a number of socket contacts 2 in openings 3. The socket contacts 2 are fixed in position in the openings 3 by means of extensions 4, which can be bent in and can be fixed into the bent-in position by means of sliders 5 (FIG. 3). A second part 6 of the housing receives a number of knife contacts 7, as shown in to FIGS. 3 and 7. As evident from FIGS. 1 and 3, the two parts 1 and 6 of the housing can be plugged together, the knife contacts 7 entering the socket contacts 2. At the housing part 1, a U-shaped clamp 9, whose legs 9' comprise expansions 9" with linking grooves 10, is pivotably-mounted on pin 8. The clamp 9 can be slid with the linking grooves 10 on pins 11 provided at the second housing part 6 (FIGS. 4 and 6), so that an optional tightening movement is exerted on the second housing part 6, pre-plugged at the housing part 1. The clamp 9 is stopped in the release position or in the pre-plug position of the housing part 6 by means of strip-shaped chamfers 12 projecting into the cutouts 19, whereby the chamfers 12 reach with bend-ins 12' behind the housing part 1.

By swivelling the clamp 9 out of the release position, (showning solid lines in FIG. 1) into the locking position, shown in dash-dotted lines, the pins 11 of the housing part 6 slide into the linking grooves 10, thus locking together the housing parts 1, 6 while assuming the final position. A recess 13, into which a locking hook 14 automatically springs when the clamp 9 is in the locking position (FIG. 3), is provided in the cross piece 9''' of the clamp 9. The locking hook 14 prevents the clamp 9 from swinging back unintentionally. If it is desired that the clamp 9 swings back for the purpose of separating the parts 1, 6 of the housing, a pressure force must be exerted from the top on the locking hook 16, whereby the strip-shaped extension 15 carrying the locking hook 14 is bent inwardly and the clamp 9 can be released. Expediently the linking grooves 10 are defined in the region of the boundary surfaces, reaching behind the pins 11, by bends 16, which reduce the surface compression between the pins 11 and the clamp 9. Furthermore, the regions of the expansions 9'' that can be guided in front of the pins 11 have other bends 17, which serve to stabilize or fasten the expansions 9''. It is obvious that preferably the locking hook 14 is mounted on an extension 15, which is deposited at least over one segment, optionally opposite the walls of the housing part 1, in order to keep the contact force for the locking hook 14 at a minimum.

Finally it is also provided in order to lock the housing parts 1,6 reliably, to swivel the parts of the expansions 9' that reach behind the pins 11 into extensions 18 of the first housing part that serve as guides, thus ruling out any unintentional lateral deflection of the expansions 9', which could result in a release of the pins 11.

We claim:

1. An electrical connector with a first housing part receiving socket contacts, and a second housing part receiving knife contacts, pins attached to said housing parts for locking together and releasing said housing parts, and a single U-shaped clamp mounted on one of said housing parts for pivoting motion about an axis between a release and a locking position, said clamp comprising legs and a cross piece, said legs having board-shaped expansions containing linking grooves which have boundary surfaces and can be swung onto pins of the other housing part, the legs being provided with springy chamfers which, in a release position, are braced as stop elements against that housing part which carries said clamp, said cross piece having a recess or hole releasably engaged by a locking hook mounted resiliently on a housing part when said clamp is in a locking position, at least said boundary surfaces reaching behind said pins having bends extending at right angles to a swivel plane defined by said legs.

2. The connector as claimed in claim 1, wherein said clamp is mounted on said first housing part.

3. The connector as claimed in claim 1, wherein said housing parts have substantially rectangular cross sections, and articulated points for said clamp are provided in opposite narrow sides of said first housing part.

4. The connector as claimed in claim 1, wherein said chamfers are strip-shaped and have a sublength which is bent in a direction of said first housing part.

5. The connector as claimed in claim 1, wherein said clamp is formed by means of a shaped sheet metal piece with attachment beads in a region of said cross piece and said legs.

6. The connector as claimed in claim 1, wherein said clamp is formed by means of a shaped sheet metal piece with attachment beads in a region of said legs.

7. The connector as claimed in claim 1, wherein at least one sublength of segments of said legs which can be guided in front of said pins have bends extending at right angles to said swivel plane.

8. The connector as claimed in claim 1, wherein those parts of said expansions which reach behind said pins can be swung into extensions of said first housing part serving as guides.

9. The connector as claimed in claim 1, wherein said locking hook is arranged on a strip-shaped extension of said first housing part and said extension can be bent down against a restoring force to release said locking hook from said recess or hole.

10. The connector as claimed in claim 9, wherein a segment of said extension is reduced in thickness relative to the walls of said first housing.

* * * * *